United States Patent [19]

Suzuki et al.

[11] Patent Number: 4,642,552

[45] Date of Patent: Feb. 10, 1987

[54] STABILIZED CURRENT SOURCE CIRCUIT

[75] Inventors: Toshiro Suzuki, Tama; Osamu Matsubara, Kokubunji, both of Japan

[73] Assignee: Hitachi, Ltd., Tokyo, Japan

[21] Appl. No.: 827,612

[22] Filed: Feb. 10, 1986

[30] Foreign Application Priority Data

Mar. 4, 1985 [JP] Japan ..... 60-41325

[51] Int. Cl.[4] ..... G05F 3/26

[52] U.S. Cl. ..... 323/315; 307/304; 323/312

[58] Field of Search ..... 323/304, 312–316; 330/288; 307/304

[56] References Cited

U.S. PATENT DOCUMENTS

| | | | |
|---|---|---|---|
| 4,020,367 | 4/1977 | Yamashiro et al. | 323/315 |
| 4,327,321 | 4/1982 | Suzuki et al. | 323/315 |
| 4,399,374 | 8/1983 | Boeke | 323/316 |

FOREIGN PATENT DOCUMENTS

| | | | |
|---|---|---|---|
| 138848 | 11/1976 | Japan . | |
| 44917 | 4/1981 | Japan | 323/311 |
| 121114 | 9/1981 | Japan | 323/315 |

OTHER PUBLICATIONS

"MOS Integrated PLL Loop Filter," 1980 National Conference Record on Communications, *The Institute of Electronics and Communication Engineers of Japan*, No. 85.

*Primary Examiner*—William H. Beha, Jr.
*Attorney, Agent, or Firm*—Antonelli, Terry & Wands

[57] ABSTRACT

For realizing a stabilized current source circuit providing a stabilized current which is insensitive to a change in the threshold voltage of a MOS transistor, a gate electrode of a first MOS transistor feeding a drain current as a constant current output is supplied with the sum of the gate-source voltage of a second MOS transistor and the potential of a stabilized voltage source.

6 Claims, 4 Drawing Figures

STABILIZED CURRENT SOURCE CIRCUIT

BACKGROUND OF THE INVENTION

This invention relates to a stabilized current source circuit and in particular to a current source circuit employing MOS transistors which supplies a constant current irrespective of the threshold voltage of the MOS transistors.

Various circuits employing MOS transistors have been made in the form of integrated circuits. Among these circuits, filters and integrators need precise current sources as described in "MOS integrated PLL loop filter", 1980 National Conference Record on Communications, The Institute of Electronics and Communication Engineers of Japan, No. 85, for example. In a simple current mitter circuit which has been widely used as the current source circuit, however, the current value unadvantageously varies largely because of nonuniformity of MOS transistor characteristics caused by the fabrication process and because of variation in temperature and in power source.

FIG. 2 shows the principle for configuring a constant current circuit employing MOS transistors. Assuming that an n-channel MOS transistor is used, bias voltage from a bias voltage source 2 is supplied between a gate electrode of an n-channel MOS transistor 1 and a source electrode thereof. As a result, a drain current $I_{D1}$ flows through the MOS transistor 1 and the value of the drain current $I_{D1}$ is represented as $$I_{D1}=\beta A(V_{GS1}-V_{TH})^2, \quad (1)$$

where:

$\beta=\mu Co/2$, $A=W_1/L_1$, $\mu$: channel mobility,

Co: gate capacitance, $W_1$: channel width, $L_1$: channel length, $V_{TH}$: threshold voltage.

In the above equation, the nonuniformity of Co, $W_1$ and $L_1$ can be limited to ten and several % by sufficiently managing the fabrication process. And the nonuniformity of $V_{GS1}$ can also be limited to ten and several % by using a well-known band-gap reference circuit. The variation in each of parameters Co, $W_1$, $L_1$ and $V_{GS1}$ due to the ambient temperature is negligible. However, the mobility $\mu$ varies in proportion to the minus one and a half power of the absolute temperature. And the threshold voltage $V_{TH}$ has fabrication nonuniformity as much as ±50% and varies as much as ±20% for a temperature change of ±50° C. Therefore, the drain current $I_{D1}$ largely varies due to the nonuniformity caused by the fabrication process and due to changes in temperature. Furthermore, the variation in power source may cause additional current change. The ratio between the maximum value of the drain current $I_{D1}$ and the minimum value thereof amounts to 5 or 6. As a result, it becomes difficult to realize an analog circuit needing a precise current source. In addition, the power dissipation of the circuit varies largely. These are primary factors hampering improvement of analog MOS integrated circuits.

As a stabilized current source circuit employing MOS transistors which is less sensitive to a change in the voltage source and a change in $V_{TH}$, a circuit comprising a combination of MOS transistors of different types, i.e., a depletion MOS transistor and an enhancement MOS transistor is known as described in "Constant Current Circuit", Japanese Patent Unexamined Publication No. 51-138848. Since the MOS transistors of different types must be combined, the fabrication process of the circuit becomes complicated. In addition, the relation between magnitudes of currents flowing through three transistors must be set as predetermined. And the gate voltage of a specific transistor must be set to a point where the temperature coefficient is zero. Thus the circuit is subjected to many constraints in its fabrication and design.

SUMMARY OF THE INVENTION

An object of the present invention is to realize a current source circuit which can be easily fabricated (that is to say, which is formed by combining the same kind of MOS transistors and which is relatively simple in circuit configuration) and which supplies a current less sensitive to a change in the threshold voltage $V_{TH}$ of the MOS transistor.

Another object of the present invention is to provide a stabilized current source circuit which is suitable to integrated circuits comprising MOS transistors.

In accordance with one aspect of the present invention, in a circuit comprising a first MOS transistor for supplying a constant current output and a second MOS transistor having a gate electrode connected to a gate electrode of the first MOS transistor and having a drain electrode connected to a current source, a stabilized voltage source having suitable magnitude and polarity is connected to a source electrode of the second MOS transistor, whereby the gate-source voltage of the second MOS transistor has a value which is sufficiently smaller than the gate-source voltage of the first MOS transistor and which is close to the threshold voltage $V_{TH}$. As a result, the voltage which is one of the factors defining the current flowing through the first MOS transistor is substantially only the voltage of the above described stabilized voltage source. And a stabilized voltage source can be realized with relative ease. Thus it becomes possible to eliminate the influence of the threshold voltage which varies most largely. In addition, the fabrication process is simple since transistors of the same type are used as the first and second MOS transistors.

The above and other objects and features of the present invention will become apparent from the description made in conjunction with the drawings.

BRIEF DESCRIPTION ,OF DRAWINGS

DESCRIPTION OF THE PREFERRED EMBODIMENTS

Figure 1:
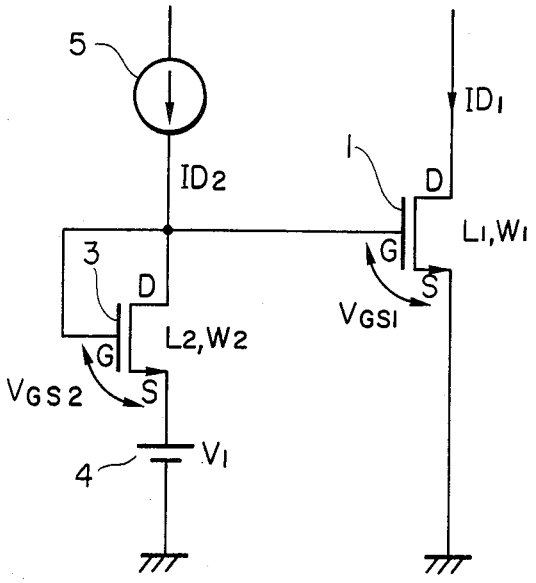
FIG. 1 is a circuit diagram of an embodiment of a stabilized current source circuit according to the present invention.

FIG. 1 is a circuit diagram for illustrating the principle of an embodiment of a stabilized current source circuit according to the present invention. An n-channel MOS transistor 1 is a current output stage. A gate electrode of the MOS transistor 1 is directly connected to a gate electrode of an n-channel MOS transistor 3. A stabilized voltage source 4 for supplying a voltage value $V_1$ (approximately 200 to 300 mV) is connected to a source electrode of the transistor 3. The polarity of the stabilized voltage source 4 viewed from the reference point (earth) is the same as the sense of the gate-source voltage of the transistor 3. That is to say, the potential of the gate G is higher than the potential of the source S in this embodiment. A current source 5 is connected to a drain electrode of the transistor 3. The gate electrode of the transistor 3 needs not be connected to the drain electrode thereof. The drain current $I_{D1}$ of the transistor 1 to be stabilized, the gate-source voltage $V_{GS1}$ of the transistor 1, the drain current $I_{D2}$ of the transistor 3, and the gate-source voltage $V_{GS2}$ of the transistor 3 can be expressed as $$I_{D1}=\beta A_1 (V_{GS1}-V_{TH})^2 \quad (2)$$

$$I_{D2}=\beta A_2 (V_{GS2}-V_{TH})^2 \quad (3)$$

$$V_{GS1}=V_{GS2}+V_1 \quad (4)$$

where:

$$A_1=W_1/L_1,\ A_2=W_2/L_2$$

$\beta$ and $V_{TH}$: the same as those in expression (1).

When $I_{D2}$ is much smaller than $I_{D1}$ ($I_{D1}/I_{D2}$ approximately 100 to 10) and $A_1$ is nearly equal to $A_2$, it follows that $$V_{GS1}-V_{TH}>V_{GS2}-V_{TH}$$

Thus, $V_{GS2}$ can be approximated as $$V_{GS2}\approx V_{TH} \quad (5)$$

From equations (4) and (5), $V_{GS1}$ can be written as $$V_{GS1}\approx V_{TH}+V_1 \quad (6)$$

By substituting equation (6) into equation (2), we get $$I_{D1}=\beta A_1 (V_1)^2 \quad (7)$$

That is to say, the drain current $I_{D1}$ of the transistor 1 is hardly affected by a change in the threshold voltage $V_{TH}$ of each transistor. By using a well-known band-gap reference circuit, for example, for supplying the voltage $V_1$, it becomes possible to realize a stabilized current source circuit which is sufficiently high in precision and stability. And the precision of $A_1$ depends on that of the mask used in the fabrication process. It is not very difficult to obtain a sufficiently high value of the precision $A_1$. The remaining problem is $\beta$ defined by the channel mobility and the gate capacitance. It is expected that the nonuniformity of $\beta$ caused by the fabrication process can be limited to approximately ±10%. And the change of the channel mobility caused by a change in temperature is ±20 to 30% for a range of ±50° C. Accordingly, the change range is significantly narrowed as compared with the circuit of the prior art in which the ratio of the maximum value of the current $I_{D1}$ to the minimum value thereof amounts to 5 to 6.

Figure 2:
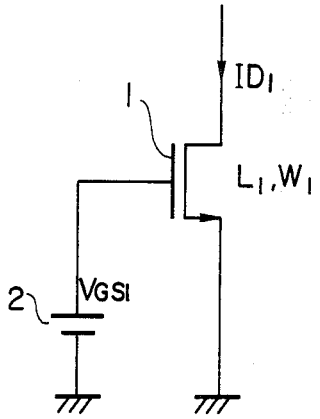
FIG. 2 PRIOR ART
FIG. 2 is a circuit diagram for illustrating the principle of a current source circuit of the prior art.
Figure 3:
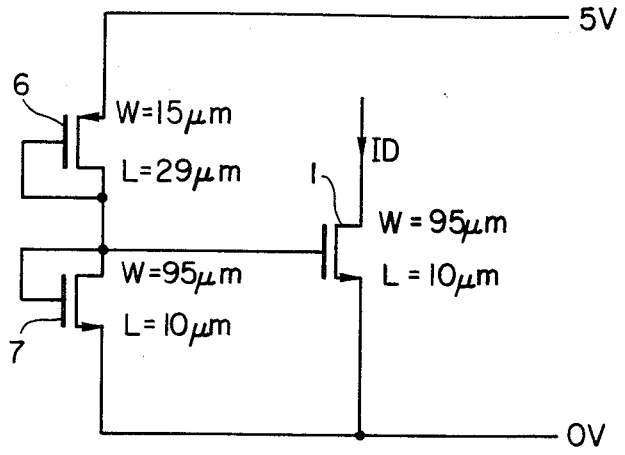
FIG. 3 PRIOR ART
FIG. 3 is a specific circuit diagram of the circuit illustrated in FIG. 2.

FIG. 3 shows a specific example of the prior art circuit realized according to the principle illustrated in FIG. 2. In this circuit, the voltage source 2 of FIG. 2 is constituted of a p-channel MOS transistor 6 and an n-channel MOS transistor 7. The circuit of FIG. 3 is a conventional so-called current mitter circuit. Values of W and L illustrated in FIG. 3 represent channel dimensions of respective transistors optimized so as to minimize the change in the current value.

Figure 4:
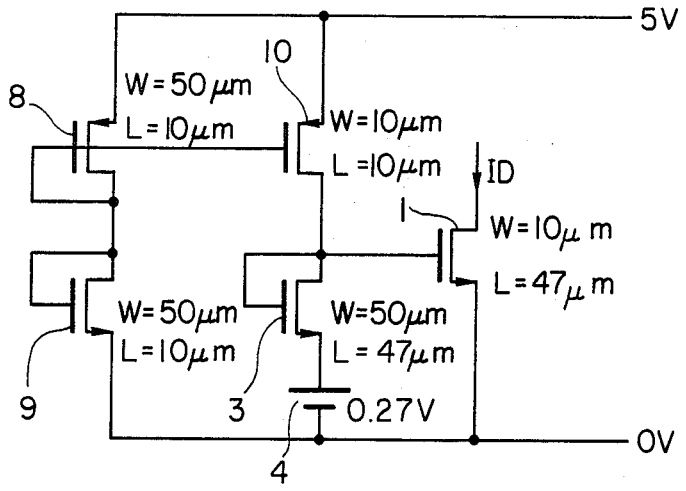
FIG. 4 is a circuit diagram of another embodiment of a stabilized current source circuit according to the present invention.

FIG. 4 shows an example of a specific circuit which is another embodiment of a stabilized current source circuit according to the present invention. The current source 5 illustrated in FIG. 1 is realized as a current mitter circuit comprising p-channel MOS transistors 8, 10 and an n-channel MOS transistor 9. The value of the voltage source 4 has been chosen to be 0.27 V. Values of W and L in FIG. 4 represent channel dimensions optimized so as to minimize the change in the current value.

The change in the output current $I_D$ was measured while the temperature, source voltage and the threshold voltage $V_{TH}$ were being changed in each of circuits illustrated in FIGS. 3 and 4. The result of measurement is shown in a table below. Each of % values in the table represent a change in $I_D$ with respect to a state B.

Comparison of Current Stability

| State | A | B | C |
|---|---|---|---|
| Temperature | −30° C. | 27° C. | 70° C. |
| Source voltage | 5.5 V | 5.0 V | 4.5 V |
| $V_{TH}$ | 0.4 V | 0.7 V | 1.1 V |
| | Minimum | Standard | Maximum |
| FIG. 3 | +97% | 0% | −50% |
| FIG. 4 | +58.8% | 0% | −30.9% |

The above table indicates that the change range of the current $I_D$ in the circuit of FIG. 4 (the present invention) is nearly reduced by half as compared with the circuit of FIG. 3 (prior art).

Although the foregoing description has been made for an n-channel MOS transistor, it also holds true for a p-channel MOS transistor. Further, although a band-gap reference circuit is ideal for the stabilized voltage source, even a simple voltage source such as a resistive voltage divider for stepping down the source voltage provides sufficient stability for some application.

We claim:

1. A stabilized current source circuit comprising:

a first MOS transistor feeding a drain current to be used as a constant current output;

a second MOS transistor having a gate electrode connected to a gate electrode of said first MOS transistor;

a current source connected to the drain electrode of said second MOS transistor; and a stabilized voltage source connected to the source of said second MOS transistor so as to keep the gate-source voltage of said second MOS transistor at a value which is closer to a threshold voltage value than the gate-source voltage of said first MOS transistor.

2. A stabilized current source circuit according to claim 1, wherein the drain electrode of said second MOS transistor is connected to the gate electrode thereof.

3. A stabilized current according to claim 2, wherein the voltage of said stabilized voltage source is 200 to 300 mV and the current of said current source is 1/10 to 1/100 times the drain current.

4. A stabilized current source circuit according to claim 2, wherein said current source comprises a current mitter circuit.

5. A stabilized current source circuit according to claim 4, wherein said current mitter circuit includes third and fourth MOS transistors respectively having drain electrodes connected together and to a common power source of a first potential value and having gate electrodes connected together, and said current miller circuit also includes a fifth MOS transistor having a source electrode which is connected to another power source of a second potential value together with the source electrode of said first MOS transistor, and wherein a source electrode of said third MOS transistor is connected to the drain electrode of said second MOS transistor, and the gate electrode of said fourth MOS transistor, a gate electrode of said fifth MOS transistor, a source electrode of said fourth MOS transistor, and the drain electrode of said fifth MOS transistor are connected together.

6. A stabilized current source circuit according to claim 3, wherein said stabilized voltage source comprises a band-gap reference circuit.

* * * * *